US007436301B2

(12) United States Patent
Norman et al.

(10) Patent No.: US 7,436,301 B2
(45) Date of Patent: Oct. 14, 2008

(54) EAS CARRIER FOR SUPPORT WITHIN A BOTTLE

(75) Inventors: Michael Norman, East Brunswick, NJ (US); Chet Kolton, Westfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 79 days.

(21) Appl. No.: 11/017,137

(22) Filed: Dec. 20, 2004

(65) Prior Publication Data

US 2006/0145862 A1 Jul. 6, 2006

(51) Int. Cl.
*G08B 13/14* (2006.01)

(52) U.S. Cl. ..... 340/568.1; 340/572.1; 340/572.8

(58) Field of Classification Search ..... 340/568.1, 340/572.8, 572.1, 572.5, 572.6; 235/375, 235/384, 385, 493
See application file for complete search history.

(56) References Cited

U.S. PATENT DOCUMENTS 4,813,564 A 3/1989 Cooper et al. ..... 215/366
5,602,530 A 2/1997 Holmgren ..... 340/568
5,625,347 A * 4/1997 MacLean et al. ..... 340/568.1
6,137,413 A 10/2000 Ryan, Jr. ..... 340/572.8
6,254,139 B1 7/2001 Fresnel ..... 283/94
6,342,838 B1 1/2002 Kolton et al. ..... 340/572.1
6,604,643 B1 8/2003 Michael et al. ..... 215/204
6,696,955 B2 2/2004 Kolton et al. ..... 340/572.8
6,831,552 B2 * 12/2004 Lin ..... 340/384.7
7,048,179 B2 * 5/2006 Claessens et al. ..... 235/375
7,061,382 B2 * 6/2006 Claessens et al. ..... 340/572.8

* cited by examiner

*Primary Examiner*—Toan N Pham
(74) *Attorney, Agent, or Firm*—Hoffmann & Baron, LLP

(57) ABSTRACT

An EAS marker carrier is designed for placement in the open neck of a container. The carrier includes a carrier body for removable insertion into the open neck of the container. The carrier body includes a closed end and an opposed open end defining an interior for receipt of an EAS marker. A peripheral structure about the open end extends outwardly therefrom. The peripheral structure has a dimension such that is seatable on the rim of the open neck of the container. The container includes a cap which closes the neck of the container and the EAS marker carrier seated thereon.

10 Claims, 3 Drawing Sheets

EAS CARRIER FOR SUPPORT WITHIN A BOTTLE

FIELD OF THE INVENTION

The present invention relates to an electronic article surveillance device used to provide theft deterrent to articles. More particularly, the present invention relates to a carrier for an EAS marker which may be placed in a container such as a bottle for deterrence of theft of the bottle.

BACKGROUND OF THE INVENTION

It is widely known to provide electronic article surveillance systems (EAS) for theft deterrence. EAS markers may be placed on or attached to, in various manners, articles which are susceptible to theft. An associated detection apparatus is placed at the exit of a facility to detect unauthorized transit of the article through the exit. Labels, tags, hangers and various other products may incorporate EAS markers to deter theft of an article to which it is attached. These markers can either be prominently displayed thereby providing clear indication to the consumer that the article is protected or can be hidden from consumer view as may be desired.

It is also known to apply EAS markers to various product containers such as bottles. Commonly assigned U.S. Pat. Nos. 6,696,955 and 6,342,838 show EAS marker assemblies which are used in combination with containers having inlet/outlet ports where the EAS marker is configured to be passable through the port for residence within the container. While the devices shown in these patents serve adequately for their purpose, the marker itself is placed in the interior of the container such that it remains loosely confined in the container during use.

U.S. Pat. No. 6,137,413 shows an EAS marker positioned within a cap of a bottle. As the EAS marker is captively retained by the cap, removal of the cap removes the EAS device from the bottle. However, the system disclosed in the '413 patent requires a cap which is specially manufactured to contain the EAS marker.

It is, therefore, desirable to provide a technique for placing an EAS marker in a container, such as a bottle, where once the product is sold and the EAS marker is no longer needed, the marker is removed from the bottle. Moreover, the EAS marker should be useable with standard bottles having standardized caps without need for specially manufactured components.

SUMMARY OF THE INVENTION

The present invention provides an EAS marker carrier for placement in the open neck of a container. The carrier includes a carrier body for insertion into the neck opening of the container. The carrier body has an open end and defines an interior for receipt of the EAS marker. A peripheral structure about the open end of the carrier extends outwardly therefrom. The structure has a dimension such that it is seatable on a rim defined by the open neck of the container.

In the preferred embodiment shown herein, the carrier body is an elongate generally cylindrical member having an annular peripheral structure extending thereabout. The annular peripheral structure is seatable on the rim of the bottle and a standard bottle cap is positionable over the annular rim to close the bottle.

The present invention also provides a theft deterrent container including a bottle having an open neck bordered by a rim. A bottle cap is positionable over the open neck. A carrier supports an EAS marker and is positioned within the open neck and captively seated between the rim of the bottle and the cap.

In the preferred embodiment, the carrier is an elongate cylindrical member having an annular member defining the peripheral structure. The annular member is seated on the rim of the bottle which is enclosed by the cap.

DETAILED DESCRIPTION OF THE PREFERRED EMBODIMENT

The present invention provides a carrier for use in a container such as a bottle which may be covered with a bottle cap. The carrier contains an EAS marker which provides theft deterrent for the container. Once the bottle is to be used by the consumer, the bottle is opened and the carrier can be removed and discarded.

Figure 1:
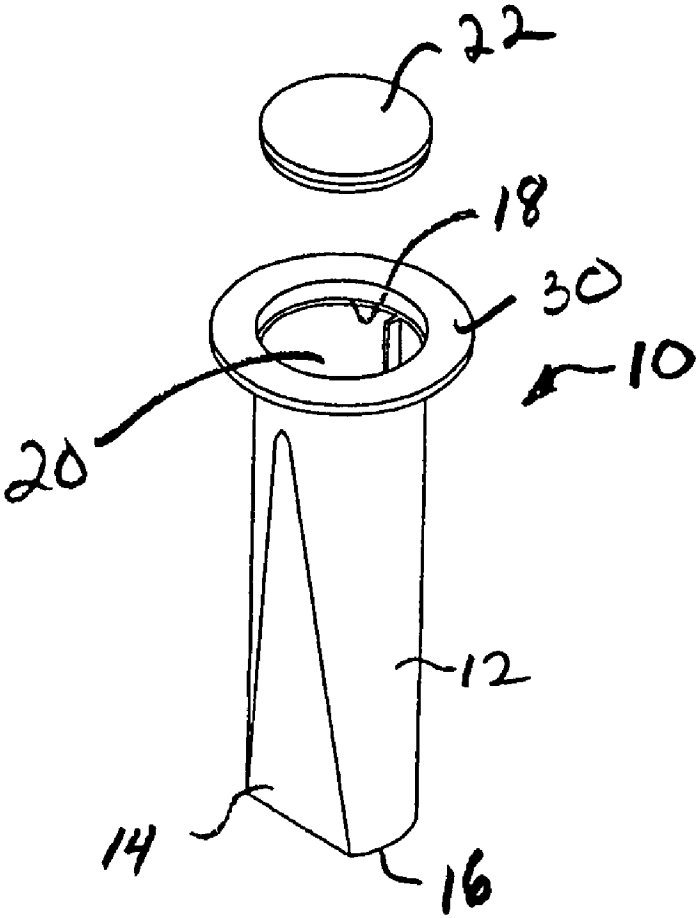

Referring to FIG. 1, the carrier 10 of the present invention is shown. Carrier 10 includes an elongate carrier body 12 which is generally cylindrical having opposed flattened walls 14. The carrier body includes a closed end 16 and an open end 18 defining a body interior 20. The interior 20 is designed to accommodate a standard EAS marker which, as well known in the art, is used with an EAS detection system to detect unauthorized movement of the article containing the marker. As many of these EAS markers are flat rectangular members (FIG. 5), the particular carrier shown in the preferred embodiment includes the flattened walls 14 so as to accommodate the marker without undue movement thereof within interior 20 of carrier body 12.

Figure 2:
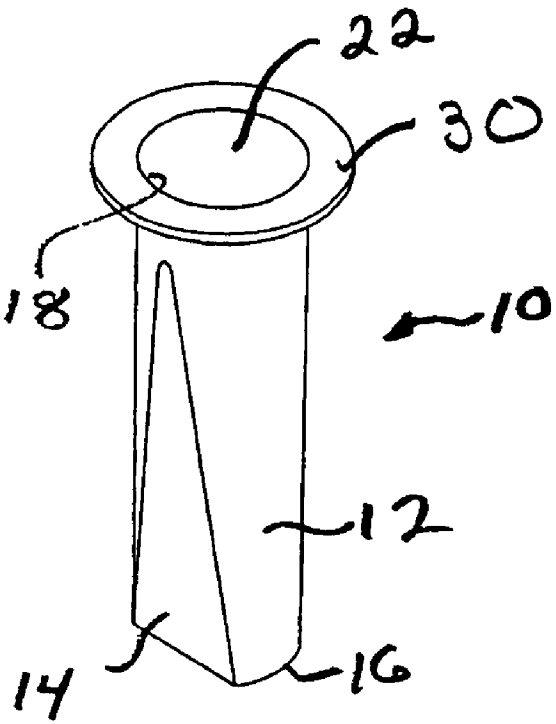
FIGS. 1 and 2 are perspective showings of an EAS carrier of the present invention shown respectively with its lid in the open and closed positions.

As shown additionally in FIG. 2, the open upper end 18 of carrier body 12 may be closed by a disk-like lid 22 once the EAS marker is placed in the interior 20 of body 12. The lid may be permanently secured by adhesive or the like to the carrier body to prevent access to the EAS marker contained therein. As particularly shown in FIGS. 1 and 2, the carrier body 12 includes a protruding annular member 30 extending about the open 18 thereof. Annular member 30, which may be formed integrally with the remainder of body 12, defines a radially extending peripheral structure about open end 18.

Figure 4:
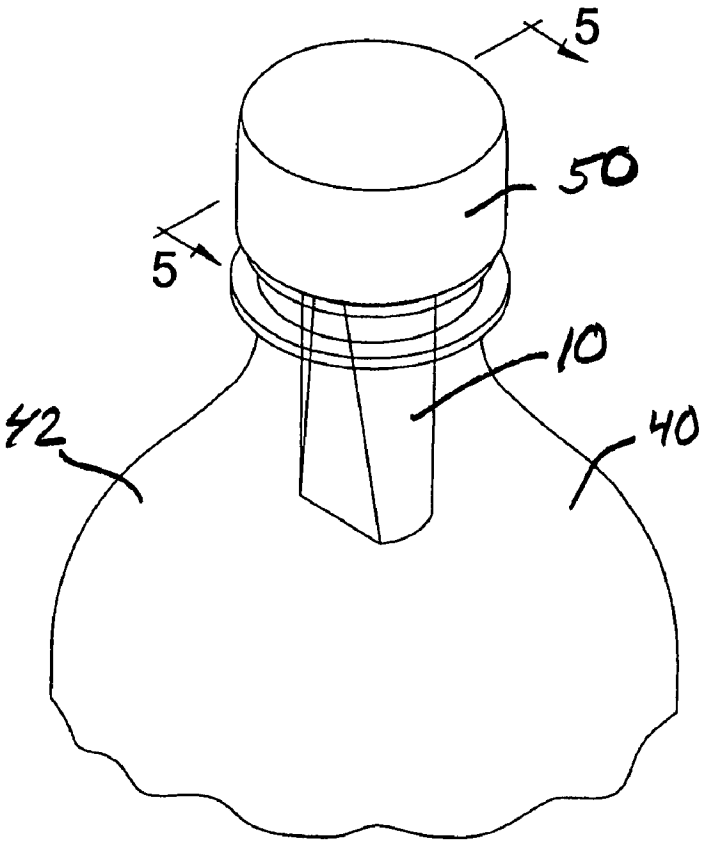
FIG. 4 shows the bottle and EAS carrier of the FIG. 4 with the bottle cap in place over the neck of the bottle.
Figure 3:
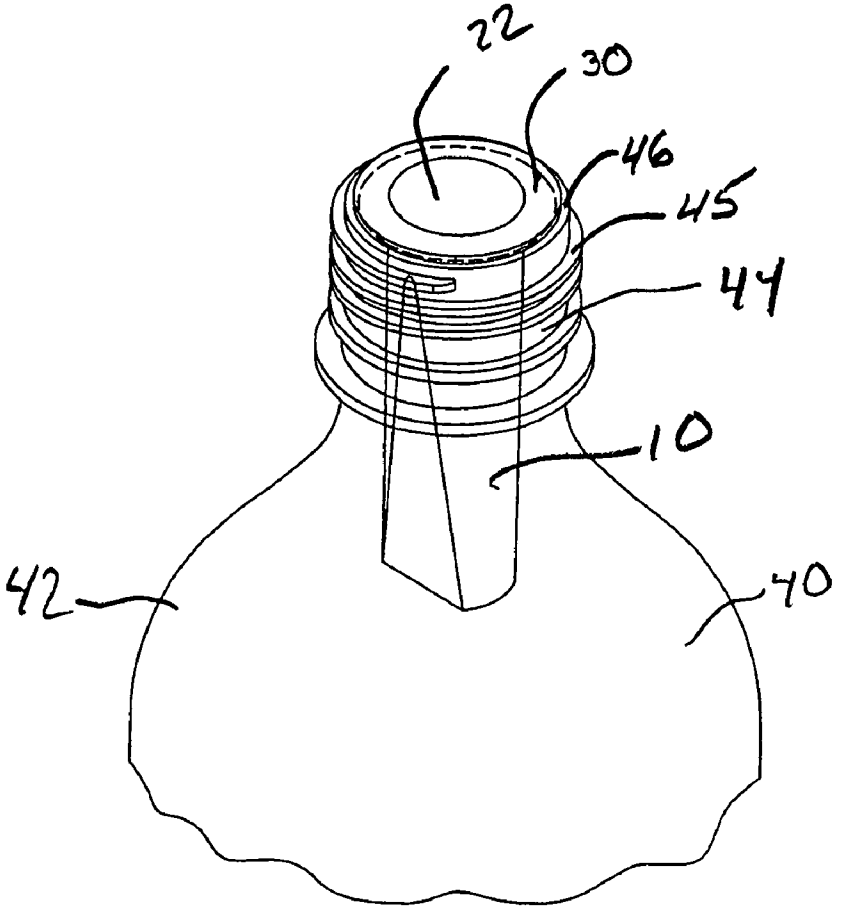
FIG. 3 is a perspective showing of a bottle with the EAS device of FIG. 1 seated in the neck thereof.
Figure 5:
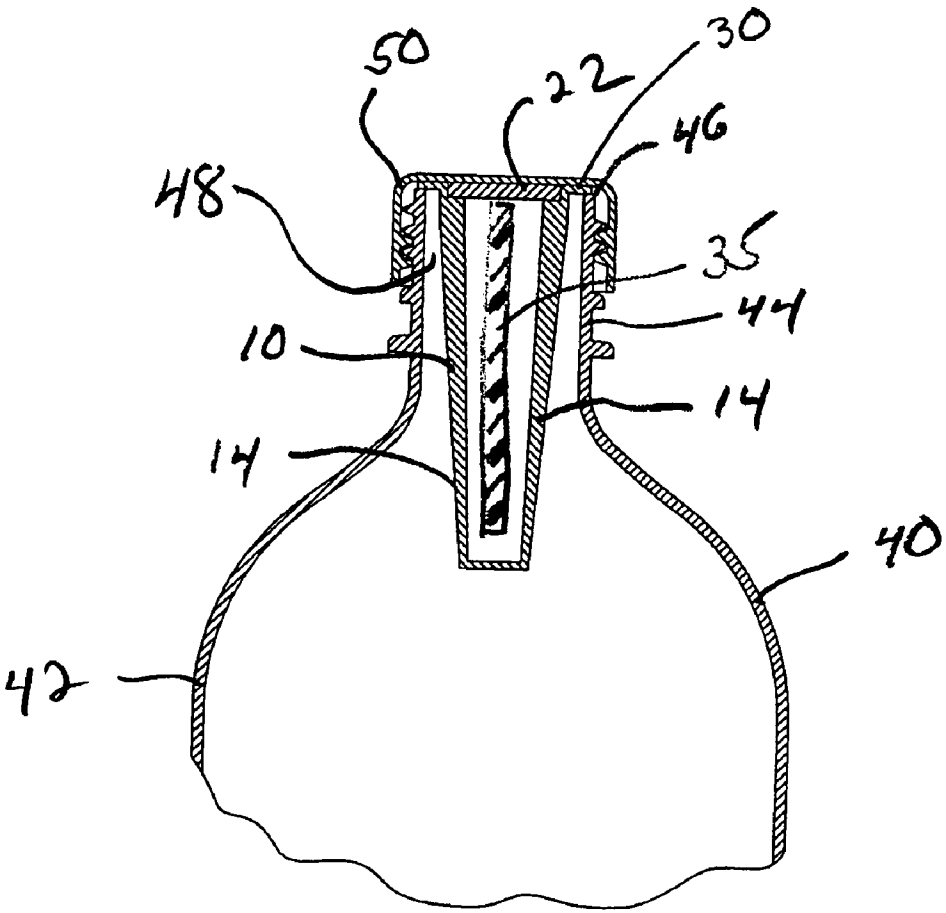
FIG. 5 is a sectional showing of the bottle of FIG. 4.

Referring now to FIGS. 3-5, the carrier 10 which would include the EAS marker 35 (FIG. 5) therein is inserted into a container such as bottle 40 so as provide theft deterrence.

In the present illustrative embodiment, the container may be a standard beverage bottle 40 having a body 42 and an extending neck 44 having external screw threads 45 which terminates in an annular rim 46 defining an open upper end 48. As particularly shown in FIG. 3, the carrier is positioned within the open neck 48 of bottle 40 such that the annular member 30 seats on top of rim 46 of bottle 40. The dimension of the annular member 30 is selected such that it seats over rim 46 so that the carrier does not fall into the bottle 40 and remains captured at neck 44. Also, the dimension of annular member 30 is such that it does not extend beyond the dimension of the rim 46 of neck 44 so that it will not interfere with the placement of a conventional bottle cap 50.

In order to use the carrier of the present invention, it is contemplated that a standard EAS marker 35 may be placed within the interior 20 of carrier 10. Thereafter, lid 22 is secured thereto to enclose the marker within the carrier. The carrier 10 then may be placed in the open end 48 of bottle 40 where due to the dimension of the annular member 30, the carrier seats on rim 46 thus supporting the carrier in the neck 44 of bottle 40. Thereafter in conventional fashion, bottle cap 50 may be applied. The bottle cap is internally threaded in standard fashion so as to mate with the external threads 45 of neck 44. As shown in FIG. 5, the positioning of the carrier 10 does not interfere with the threaded closure of the bottle cap 50 to the bottle 46.

The carrier 10, including the EAS marker 35 therein, provides effective theft deterrent for the bottle when used with an associated EAS surveillance system. Once the bottle has been purchased and the user opens the bottle, the user can discard the carrier and use the bottle. Since the carrier is easily discarded prior to use, the carrier need not remain with the bottle during such use.

Various changes to the foregoing described and shown structures will now be evident to those skilled in the art. Accordingly, the particularly disclosed scope of the invention is set forth in the following claims.

What is claimed is:

1. A theft deterrent container comprising:

a bottle having an open neck bordered by a rim;

an EAS marker;

a carrier supporting said EAS marker, said carrier being removably insertable into said open neck of said bottle and seated on said rim of said bottle; and a bottle cap positionable over and removable from said inserted carrier and said open neck so as to captively retain said carrier seated on said rim and removable therefrom to permit discarding of said carrier and subsequent reuse of said bottle and said cap.

2. A container of claim 1 wherein said carrier includes a carrier body having an open end adjacent said bottle rim, a closed end extending into said open neck and a body interior which accommodates said EAS marker.

3. A container of claim 2 wherein said carrier body includes a peripheral structure about said open end, said peripheral structure being seated on said rim of said bottle.

4. A container of claim 3 wherein said carrier body is generally cylindrical and said peripheral structure is an annular member.

5. A container of claim 1 further including a lid for enclosing said open end of said carrier body.

6. A method of providing a theft deterrent container comprising the steps of:

(a) providing a bottle having an open neck bounded by a rim;

(b) placing an EAS marker in a carrier;

(c) inserting said carrier into said open neck of said bottle so as to seat on said rim;

(d) subsequent to step (c), removably attaching a bottle cap onto said open neck of said bottle to captively retain said carrier seated on said rim.

7. A method of claim 6 wherein said carrier is removable from said bottle.

8. A method of claim 7 wherein said cap is removable from said bottle and said carrier.

9. A method of claim 6 wherein said carrier includes a peripheral structure and wherein said inserting step includes:

seating said peripheral structure on said rim.

10. A method of claim 6 wherein said carrier includes a carrier body having an open end and wherein placing step further includes:

inserting said EAS marker into said carrier body through said open end; and covering said open end with a lid.

* * * * *